US007550929B2

(12) United States Patent
Ger et al.

(10) Patent No.: US 7,550,929 B2
(45) Date of Patent: Jun. 23, 2009

(54) POWER SYSTEM AND METHOD FOR DRIVING PLURAL LAMPS

(75) Inventors: Chih-Chan Ger, Shenzhen (CN); Wen-Lin Chen, Shenzhen (CN)

(73) Assignee: Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 291 days.

(21) Appl. No.: 11/308,580

(22) Filed: Apr. 8, 2006

(65) Prior Publication Data

US 2007/0046218 A1 Mar. 1, 2007

(30) Foreign Application Priority Data

Aug. 26, 2005 (CN) ..... 2005 1 0036917

(51) Int. Cl.
*H05B 41/16* (2006.01)

(52) U.S. Cl. ..... 315/282; 315/274; 315/312; 315/224; 315/291

(58) Field of Classification Search ..... 315/274–289, 315/291, 307–326, 224, 225, 209 R
See application file for complete search history.

(56) References Cited

U.S. PATENT DOCUMENTS

| | | | | |
|---|---|---|---|---|
| 4,479,175 | A * | 10/1984 | Gille et al. | 363/41 |
| 4,706,177 | A * | 11/1987 | Josephson | 363/24 |
| 4,823,249 | A * | 4/1989 | Garcia, II | 363/48 |
| 5,387,821 | A * | 2/1995 | Steciuk et al. | 307/105 |
| 5,619,080 | A * | 4/1997 | Pennington et al. | 307/105 |
| 7,382,887 | B2 * | 6/2008 | Brodkin | 381/94.1 |
| 7,397,676 | B2 * | 7/2008 | Lincoln et al. | 363/56.01 |
| 2002/0130628 | A1 * | 9/2002 | Shin | 315/312 |
| 2005/0007034 | A1 * | 1/2005 | Kobayashi et al. | 315/291 |
| 2005/0093472 | A1 | 5/2005 | Jin | |
| 2005/0146286 | A1 | 7/2005 | Chan et al. | |
| 2005/0258778 | A1 * | 11/2005 | Chen | 315/209 R |
| 2006/0061305 | A1 * | 3/2006 | Ahn et al. | 315/312 |
| 2006/0125424 | A1 * | 6/2006 | Gray | 315/312 |
| 2006/0158136 | A1 * | 7/2006 | Chen | 315/308 |
| 2006/0284568 | A1 * | 12/2006 | Chang et al. | 315/282 |
| 2007/0114952 | A1 * | 5/2007 | Yang | 315/307 |
| 2007/0120504 | A1 * | 5/2007 | Bai et al. | 315/291 |

FOREIGN PATENT DOCUMENTS

| | | |
|---|---|---|
| CN | 1092914 A | 9/1994 |
| CN | 1578580 A | 2/2005 |
| TW | 521947 | 2/2003 |

* cited by examiner

*Primary Examiner*—Tuyet Vo
(74) *Attorney, Agent, or Firm*—Wei Te Chung

(57) ABSTRACT

A power system for driving plural or multiple lamps includes a transformer circuit, a filter and steady-flow circuit, and a light source. The transformer circuit transforms a voltage level of an input AC signal, and includes a first output end for outputting a first AC signal, and a second output end for outputting a second AC signal. The first and second AC signals are opposite in phase. The filter and steady-flow circuit includes a first plurality of filter and steady-flow units connected to the first output end for suppressing harmonic signals of the first AC signal and outputting a plurality of third AC signals. The light source has a first plurality of lamps, each of which having one end connected to one of a respective one of the first plurality of filter and steady-flow units so as to be driven by a respective one of the third AC signals.

14 Claims, 13 Drawing Sheets

POWER SYSTEM AND METHOD FOR DRIVING PLURAL LAMPS

FIELD OF THE INVENTION

The invention relates to electrical power systems, and particularly to a power system and method for driving plural or multiple lamps.

DESCRIPTION OF RELATED ART

Discharge lamps, especially Cold Cathode Fluorescent Lamps (CCFLs), are used as light sources for Liquid Crystal Display (LCD) panels. Typically, CCFLs are driven by inverter circuits. An inverter circuit provides alternating current signals to CCFLs, and includes a feedback control circuit to maintain stability of current flowing through the CCFLs. For larger LCD panels, two or more CCFLs are typically required to provide sufficient luminance.

FIG. 1 is a schematic diagram of a typical power system for driving multiple lamps. As depicted in FIG. 1, the power system includes a converter circuit 101, a transformer and filter circuit 103, a current balancing circuit 105, a light source 107, and a feedback control circuit 109. The converter circuit 101 converts an inputted direct current (DC) signal to an alternating current (AC) signal. The transformer and filter circuit 103, which is connected to the converter circuit 101, transforms a voltage level of the AC signal. The transformer and filter circuit 103 also filters and suppresses harmonic signals of the AC signal. Typically, the transformer and filter circuit 103 includes a transformer T1, and a capacitor C1 coupled between two ends of a secondary winding of the transformer T1. The leakage inductance of the transformer T1 and the capacitance of the capacitor C1 forms an LC filter for filtering outputted AC signals of the transformer T1. The current balancing circuit 105 is coupled between the transformer and filter circuit 103 and the light source 107. The light source 107 has two or more lamps, wherein currents flowing through the lamps may be different on account of different impedances inherent therein. Therefore, the current balancing circuit 105 is needed to balance current flowing through each lamp. The feedback control circuit 109, coupled between the light source 107 and the converter circuit 101, is used for controlling the converter circuit 101 according to feedback signals received from the light source 107.

FIG. 2 shows details associated with a transformer and filter circuit 103*a* of a typical power system. The transformer and filter circuit 103*a* includes a transformer T1, and a capacitor C1 coupled between two ends of the secondary winding of the transformer T1. A current balancing circuit 105*a* includes multiple transformers T11, T12, . . . , and T1*n*. Primary windings of the transformers T11, T12, . . . , and T1*n* are respectively coupled between one end of the secondary winding of the transformer T1 and one end of multiple lamps Lp11, Lp12, . . . , and Lp1*n*, and secondary windings of the transformers T11, T12, . . . , and T1*n* are connected in series to complete a loop.

As shown in FIG. 2, plural transformers (T11, T12, etc.) are required in the current balancing circuit 105*a* when there are plural lamps (Lp11, Lp12, etc.) in a light source 107*a*. As such, both the size and the cost of the current balancing circuit 105*a* are greater when compared to a single-lamp system. In addition, the leakage inductance in the LC filter of the transformer and filter circuit 103*a* increases the size of the transformer T1, which results in a high cost for the power system.

FIG. 3 is a schematic diagram of another typical power system for driving multiple lamps. The difference between the systems of FIG. 3 and FIG. 1 is that a transformer and filter circuit 103*b* of FIG. 3 includes multiple transformers T1, T2, . . . , and Tn, and multiple capacitors C1, C2, . . . , and Cn. Each pair of corresponding transformer and capacitor forms a transformer and filter unit that is connected to a respective lamp of the light source 107. In other words, each transformer and filter unit drives a corresponding lamp.

FIG. 4 is a schematic diagram of a further typical power system for driving multiple lamps. The difference between the systems of FIG. 4 and FIG. 1 is that a transformer and filter circuit 103*c* includes a transformer and multiple capacitors C1, C2, . . . and Cn. The transformer includes multiple windings W1, W2, . . . , Wn that are wound around a magnetic core. Each pair of corresponding winding and capacitor forms a transformer and filter unit. Each transformer and filter unit drives a respective lamp of the light source 107 connected thereto. Due to space limitations, the number of windings W1, W2, . . . , Wn of the transformer is restricted, because each winding takes up a certain amount of space.

The power systems for driving multiple lamps of FIGS. 3 and 4 use the transformer and filter units to drive the lamps without a current balancing circuit. Thus, the size and cost of the transformer and filter circuit will be increased if more lamps are required in the light source.

SUMMARY OF INVENTION

A preferred embodiment of the invention provides a power system for driving plural lamps. The power system includes a transformer circuit, a filter and steady-flow circuit, and a light source. The transformer circuit transforms a voltage level of an input alternating current (AC) signal, and includes a first output end for outputting a first AC signal and a second output end for outputting a second AC signal. The first AC signal and the second AC signal are opposite in phase. The filter and steady-flow circuit includes a first plurality of filter and steady-flow units connected to the first output end for suppressing harmonic signals of the first AC signal and outputting a plurality of third AC signals. The light source includes a first plurality of lamps. Each of the first plurality of lamps has one end connected to a respective one of the first plurality of filter and steady-flow units so as to be driven by a respective one of the plurality of third AC signals.

Another preferred embodiment of the invention provides a power system for driving plural lamps. The power system includes a transformer circuit, a filter and steady-flow circuit, and a light source. The transformer circuit transforms a voltage level of an input AC signal, and includes a first output end for outputting a first AC signal and a second output end for outputting a second AC signal. The first AC signal and the second AC signal are opposite in phase. The filter and steady-flow circuit includes a plurality of filter and steady-flow units respectively connected to the first output end and the second output end for suppressing harmonic signals of the first AC signal and the second AC signal. Each of the plurality of filter and steady-flow units includes a third output end and a fourth output end. The third output end and the fourth output end respectively output a plurality of third AC signals and a plurality of fourth AC signals that are substantially the same in magnitude but opposite in phase. The light source includes a first plurality of lamps, and each of the first plurality of lamps has one end connected to the third output end of a corresponding one of the plurality of filter and steady-flow units so as to be driven by a corresponding one of the plurality of third AC signals.

A method for driving plural lamps according to a further preferred embodiment of the invention includes the steps of:

receiving a direct current signal; converting the direct current signal to a square-wave AC signal; transforming a voltage level of the square-wave AC signal; converting the square-wave AC signal to a plurality of sine-wave AC signals substantially the same in magnitude; and outputting the sine-wave AC signals to the lamps.

The filter and steady-flow units of the filter and steady-flow circuit can balance current flowing through each lamp of the light source, and there is no need for a current balancing circuit. In addition, each of the plurality of filter and steady-flow units is coupled between the transformer circuit and one corresponding lamp of the light source, and leakage inductance of the transformer circuit may not be considered. Thus, a size of a transformer of the transformer circuit can be reduced.

Other advantages and novel features will become more apparent from the following detailed description when taken in conjunction with the accompanying drawings. Like reference numerals denote like components throughout the several views.

DETAILED DESCRIPTION

Figure 1:
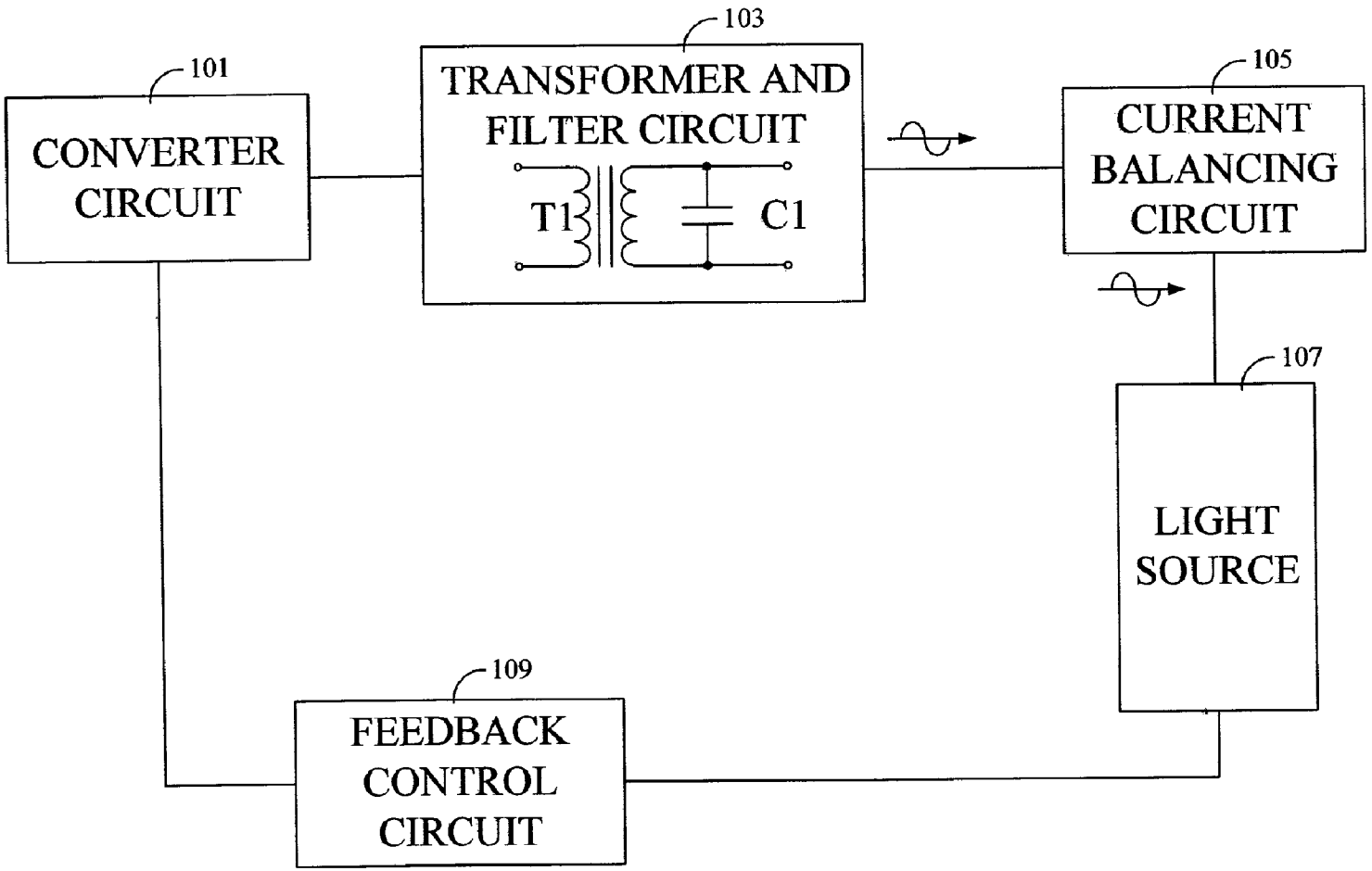
FIG. 1 (Related Art)
FIG. 1 is a schematic diagram of a conventional power system for driving multiple lamps.
Figure 2:
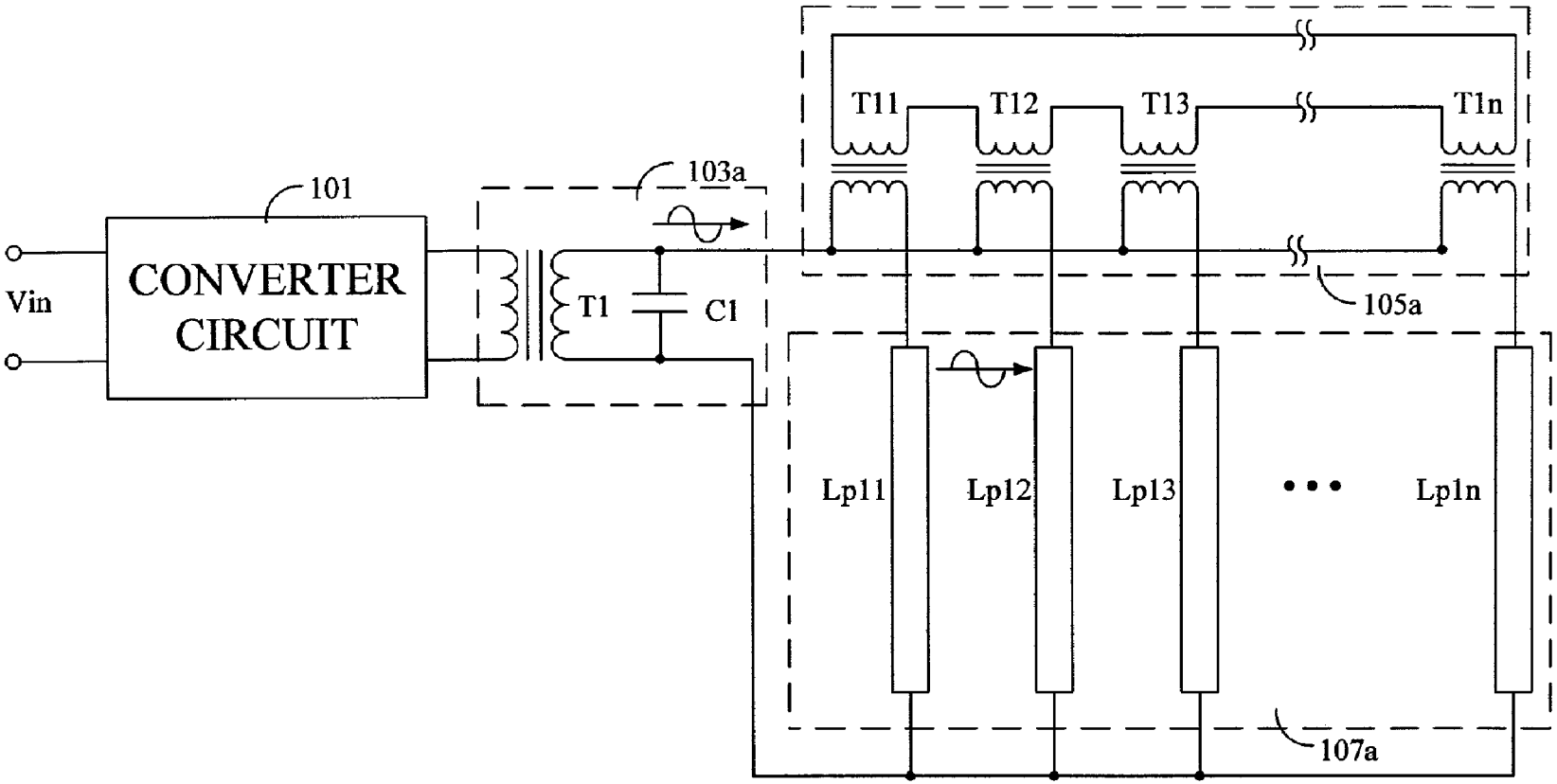
FIG. 2 (Related Art)
FIG. 2 shows details associated with a transformer and filter circuit of the power system of FIG. 1.
Figure 3:
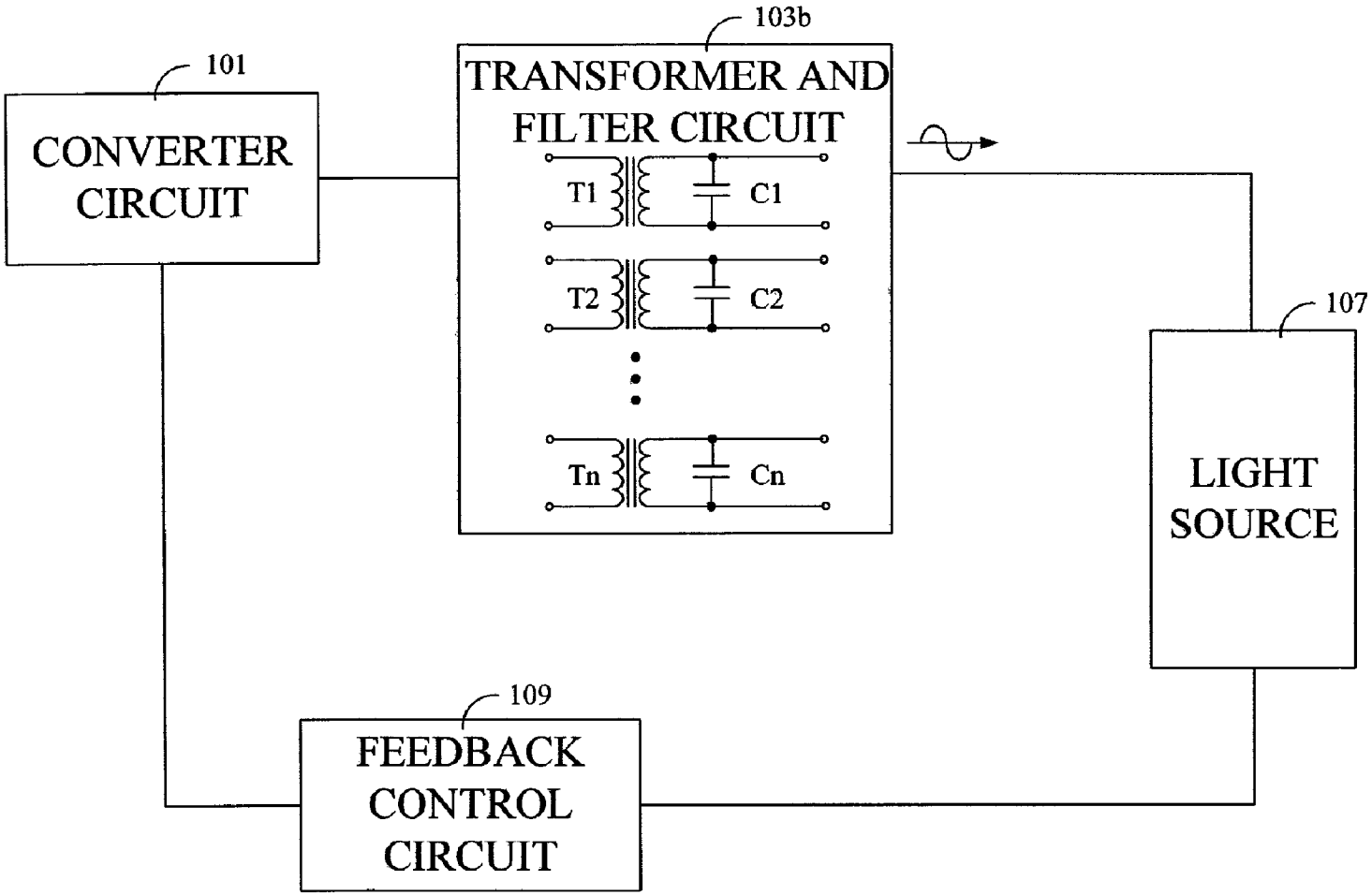
FIG. 3 (Related Art)
FIG. 3 is a schematic diagram of another conventional power system for driving multiple lamps.
Figure 4:
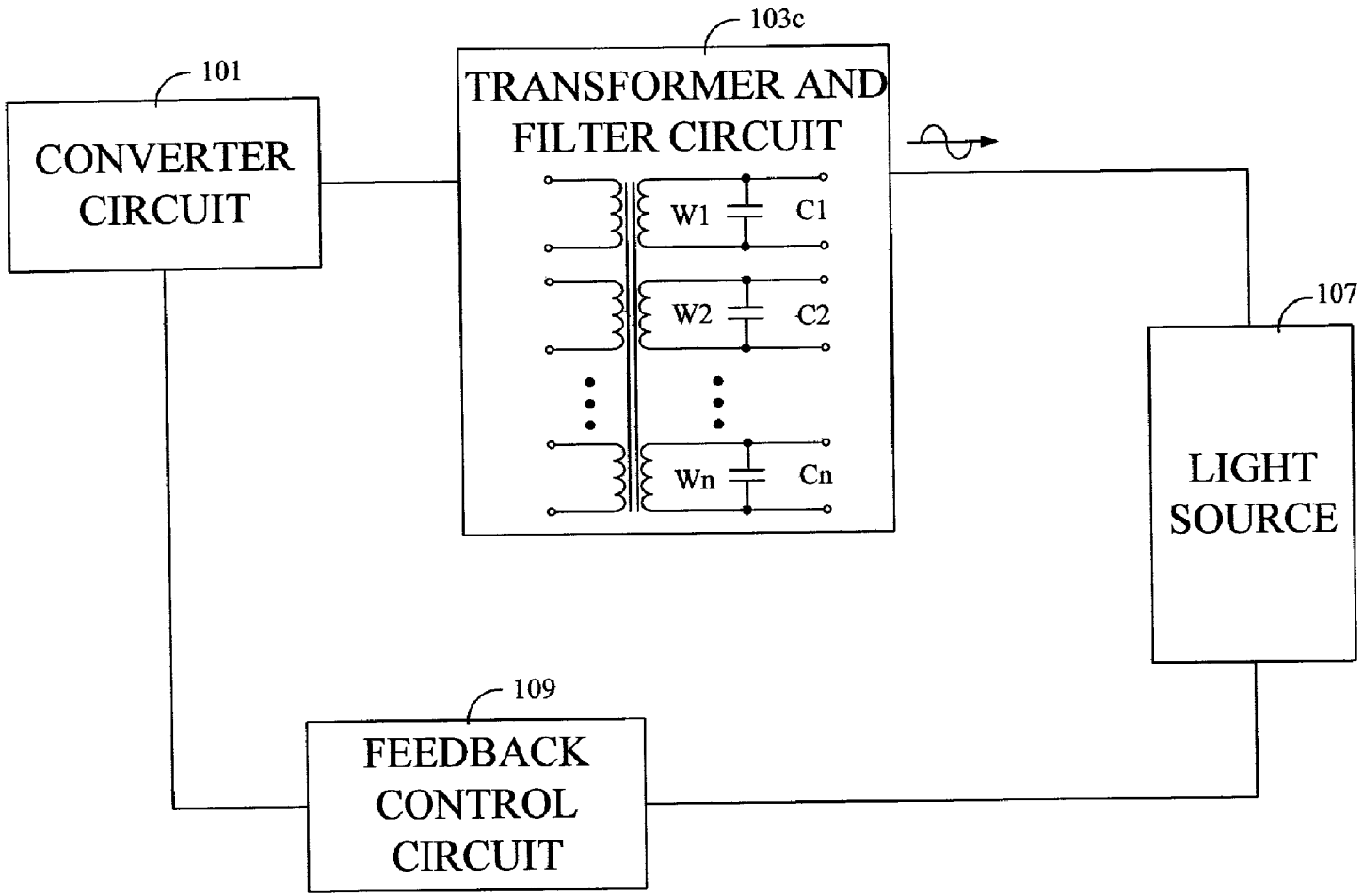
FIG. 4 (Related Art)
FIG. 4 is a schematic diagram of a further conventional power system for driving multiple lamps.
Figure 5:
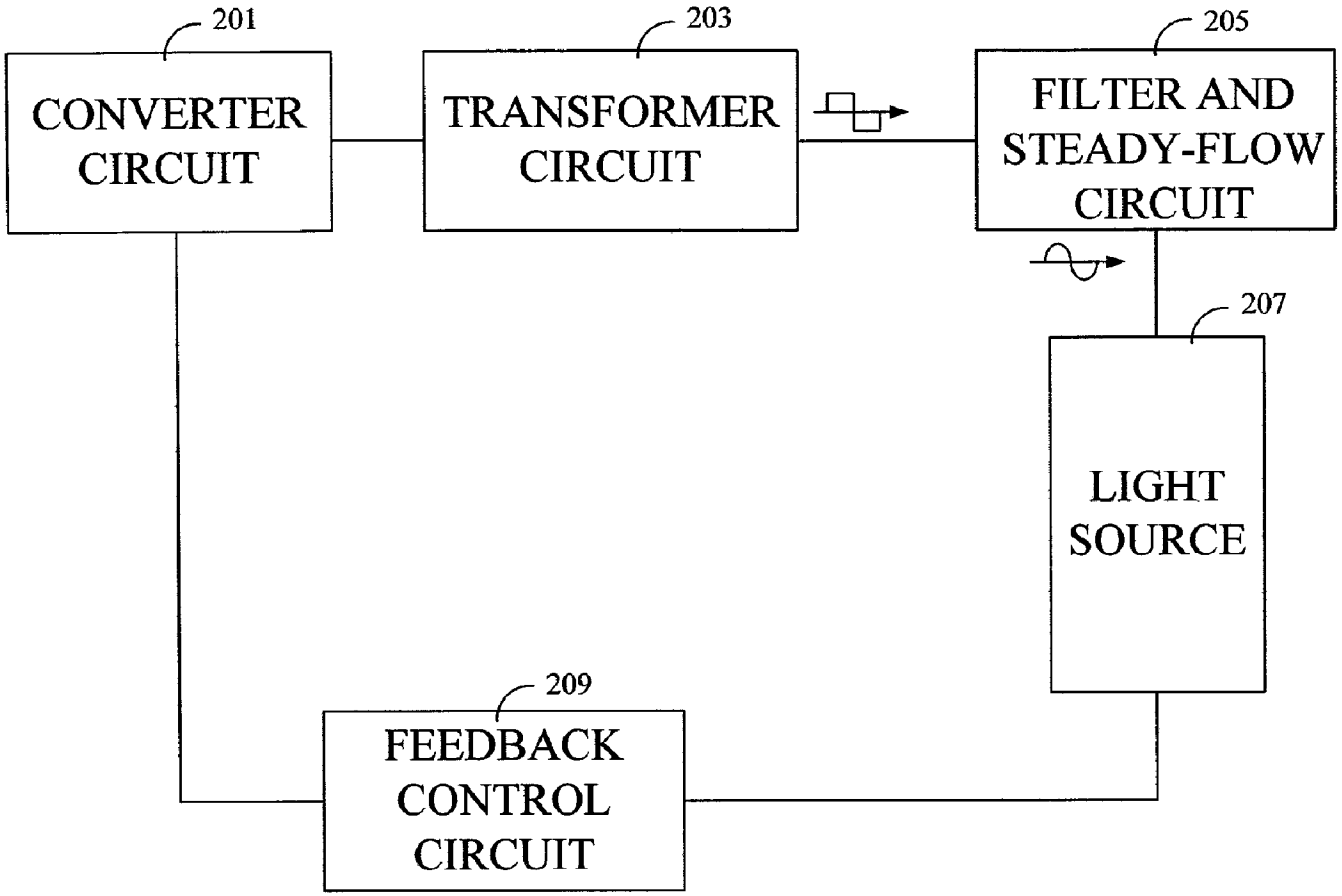
FIG. 5 is a schematic diagram of a power system for driving multiple lamps in accordance with a first preferred embodiment of the invention.

FIG. 5 is a schematic diagram of a power system for driving multiple lamps (hereinafter the power system) in accordance with a first preferred embodiment of the invention. In this first preferred embodiment, the power system of the invention includes a converter circuit 201, a transformer circuit 203, a filter and steady-flow circuit 205, a light source 207, and a feedback control circuit 209. The converter circuit 201 converts an input direct current (DC) signal to a square-wave alternating current (AC) signal. The converter circuit 201 may be a half-bridge converter circuit, a full-bridge converter circuit, or a push-pull converter circuit. The transformer circuit 203 is connected to the converter circuit 201. The transformer circuit 203 transforms a voltage level of the AC signal to provide power for the light source 207. The filter and steady-flow circuit 205 is coupled between the transformer circuit 203 and the light source 207. The filter and steady-flow circuit 205 filters and suppresses harmonic signals of the AC signal, and outputs the filtered AC signals to the light source 207. The feedback control circuit 209 is coupled between the light source 207 and the convener circuit 201. The feedback control circuit 209 controls the converter circuit 201 according to feedback signals received from the light source 207.

Figure 6:
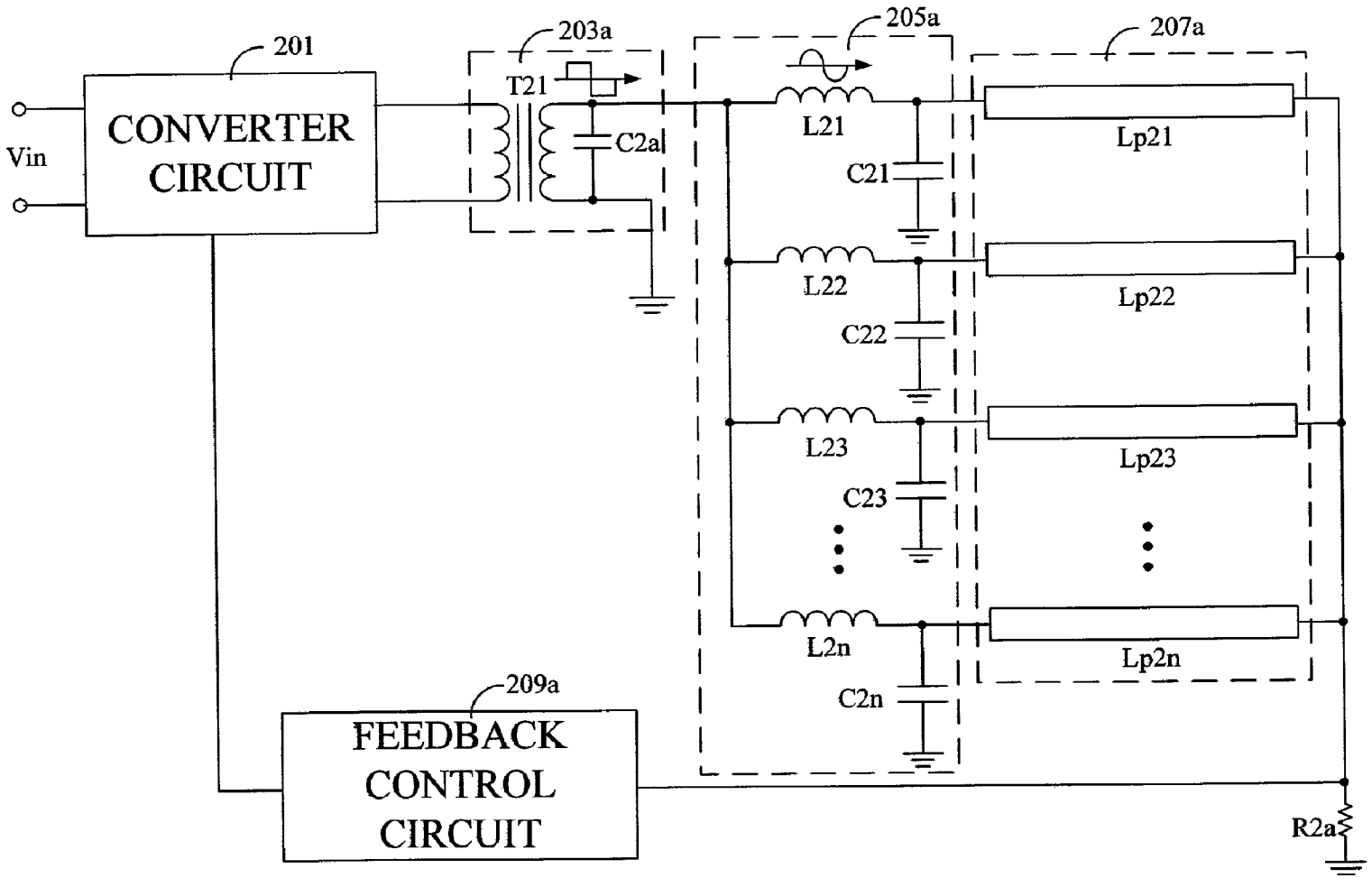
FIG. 6 shows a circuit diagram of the first preferred embodiment of FIG. 5.

FIG. 6 shows an exemplary circuit diagram of the first preferred embodiment of FIG. 5. In this embodiment, the converter circuit 201 receives an input DC signal Vin, and converts the DC signal Vin to an AC signal. A transformer circuit 203*a* includes a transformer T21. The transformer T21 includes a primary winding connected to the converter circuit 201. The transformer T21 transforms a voltage level of the AC signal, and outputs the transformed AC signal from a secondary winding of tire transformer T21. One end of the secondary winding of the transformer T21 is a first output end, and the other end thereof is a second output end. The first output end of the transformer T21 outputs a first AC signal, while the second output end outputs a second AC signal. The first AC signal and the second AC signal are opposite in phase. The transformer circuit 203*a* also includes a capacitor C2*a* coupled between the first output end and the second output end of the transformer T21. The capacitor C2*a* suppresses high-frequency signals generated by leakage inductance and parasitic capacitance of the transformer T21. A filter and steady-flow circuit 205*a* preferably includes multiple inductors L21, L22, . . ., L2*n* and multiple capacitors C21, C22, . . ., C2*n*. Multiple filter and steady-flow units are formed by the inductors L21, L22, L2*n* and the corresponding capacitors C21, C22, . . ., C2*n*. The multiple filter and steady-flow units are respectively coupled between corresponding lamps Lp21, Lp22, . . . , Lp2*n* and the first output end of the secondary winding of the transformer T21. For example, a first filter and steady-flow unit, which is formed by the inductor L21 and the capacitor C21, is coupled between the first output end of the secondary winding of the transformer T21 and the lamp Lp21. The multiple filter and steady-flow units filter and suppress harmonic signals of the first AC signal. The multiple filter and steady-flow units output third AC signals. Each of the third AC signals is substantially equal in magnitude. The lamps Lp21, Lp22, . . ., Lp2*n* are driven by the third AC signals.

In the exemplary embodiment first ends of the multiple inductors L21, L22,. . . , L2*n* are commonly connected to the first output end of the secondary winding of the transformer T21, and second ends of the multiple inductors L21, L22, . . . , L2*n* are respectively connected to first ends of the lamps Lp21, Lp22, . . . , Lp2*n* of a light source 207*a*. The second output end of the secondary winding of the transformer T21 is grounded. Each of the capacitors C21, C22, . . . C2*n* has one end respectively connected to the corresponding inductor L21, L22, . . . , L2*n* and the corresponding lamp Lp21, Lp22, . . . , Lp2*n*, and the other end thereof is grounded. Second ends of the lamps Lp21, Lp22, . . . , Lp2*n* are grounded through a resistor R2*a*, and are also connected to a feedback control circuit 209*a*. In another exemplary embodiment, the resistor R2*a* may be replaced by other kind of impedance element. The feedback control circuit 209*a* is coupled between the lamps Lp21, Lp22, . . . Lp2*n* of the light source 207*a* and the converter circuit 201.

The principle of the filter and steady-flow circuit 205*a* is described hereinafter by an exemplary circuit that includes the inductor L21, the capacitor C21, and the lamp Lp21. In the exemplary circuit, the lamp Lp21 is a preferably a Cold Cathode Fluorescent Lamp (CCFL), which is preferably driven by an AC signal. The AC signal preferably ranges between about 30 KHz and about 100 KHz. The AC signal outputted by the converter circuit 201 should be provided at a relatively high frequency so that the equivalent impedance of the inductor L21 is relatively high. Under this condition, the inductor L21 may be considered as a current source, and the influence of impedance variance on current flowing through the lamp Lp21 may be ignored. In addition, because the impedance associated with each of the inductors L21, L22,. . . , L2*n* is substantially the same, and because the impedance associated with each of the capacitors C21, C22, . . . , C2*n* is also substantially the same, each of the third AC signals that flows through each of the lamps Lp21, Lp22, . . . , Lp2*n* is also substantially the same. Therefore, the difference in the impedance of the lamps Lp21, Lp22, . . . , Lp2*n* has less influence on the currents flowing therethrough. As a result, the power system does not need a current balancing circuit.

In this preferred embodiment, the inductor L21 and the capacitor C21 form an LC filter that filters and suppresses harmonic signals of the first AC signal. This results in the transformer T21 being relatively small and less costly. The power system uses the transformer T21 to drive multiple lamps Lp21, Lp22, . . . , Lp2*n*. Because each of the lamps Lp21, Lp22, . . . , Lp2*n* is connected to a respective one of the corresponding inductors L21, L22, . . . , L2*n*, a short-voltage across each of the lamps Lp21, L22, . . . , L2*n* and an open-voltage across each of the lamps Lp21, L22, . . . , L2*n* are significantly different. Thus, it is convenient to design a protection circuit for the lamps Lp21, L22, . . . , L2*n*.

F*ig*. 7 shows an alternative exemplary circuit diagram of the first preferred embodiment of FIG. 5. A filter and steady-flow circuit 205*b* of FIG. 7, in addition to having multiple first filter and steady-flow units, further includes multiple second filter and steady-flow units. Also, the power system includes a light source 207*b* that has multiple first lamps Lp3l, Lp32, . . . Lp3*n* and multiple second lamps Lp4l, Lp42, . . . , Lp4*n*. Each inductor L31, L32, . . . , L3*n* forms a first filter and steady-flow unit with a corresponding capacitor C31, C32, . . . , C3*n*. Each inductor L41, L42, . . . , L4*n* forms a second filter and steady-flow unit with a corresponding capacitor C41, C42, . . . , C4*n*. Elements and connections of the first filter and steady-flow units and the second filter and steady-flow units shown in FIG. 7 can be the same as those of corresponding elements and connections of the filter and steady-flow units shown in FIG. 6. The first filter and steady-flow units are connected to a first output end of a secondary winding of a transformer T31. The first filter and steady-flow units filter and suppress harmonic signals of a first AC signal outputted from the first output end. The first filter and steady-flow units output third AC signals, which are substantially equal in magnitude to the first AC signals. The second filter and steady-flow units are connected to a second output end of the secondary winding of the transformer T31. The second filter and steady-flow units filter and suppress harmonic signals of a second AC signal outputted from the second output end. The second filter and steady-flow units output fourth AC signals that are substantially equal in magnitude to the second AC signal. The third and the fourth AC signals are opposite in phase.

Each of the first lamps Lp31, Lp32, . . . , Lp3*n* of the light source 207*b* has one end connected to the corresponding first filter and steady-flow unit, and each of the first lamps Lp31, Lp32, . . . , Lp3*n* is respectively driven by a third AC signal. Each of the second lamps Lp41, Lp42, . . . , Lp4*n* of the light source 207*b* has one end connected to the corresponding second filter and steady-flow unit, and each of the second lamps Lp41, Lp42, . . . , Lp4*n* is respectively driven by a fourth AC signal.

In this preferred embodiment, the impedance associated with each of the inductors L31, L32, . . . , L3*n*, L41, L42, . . . , L4*n* is substantially the same, and the impedance associated with each of the capacitors C31, C32, . . . , C3*n*, C41, C42, . . . , C4*n* is substantially the same.

Figure 8:
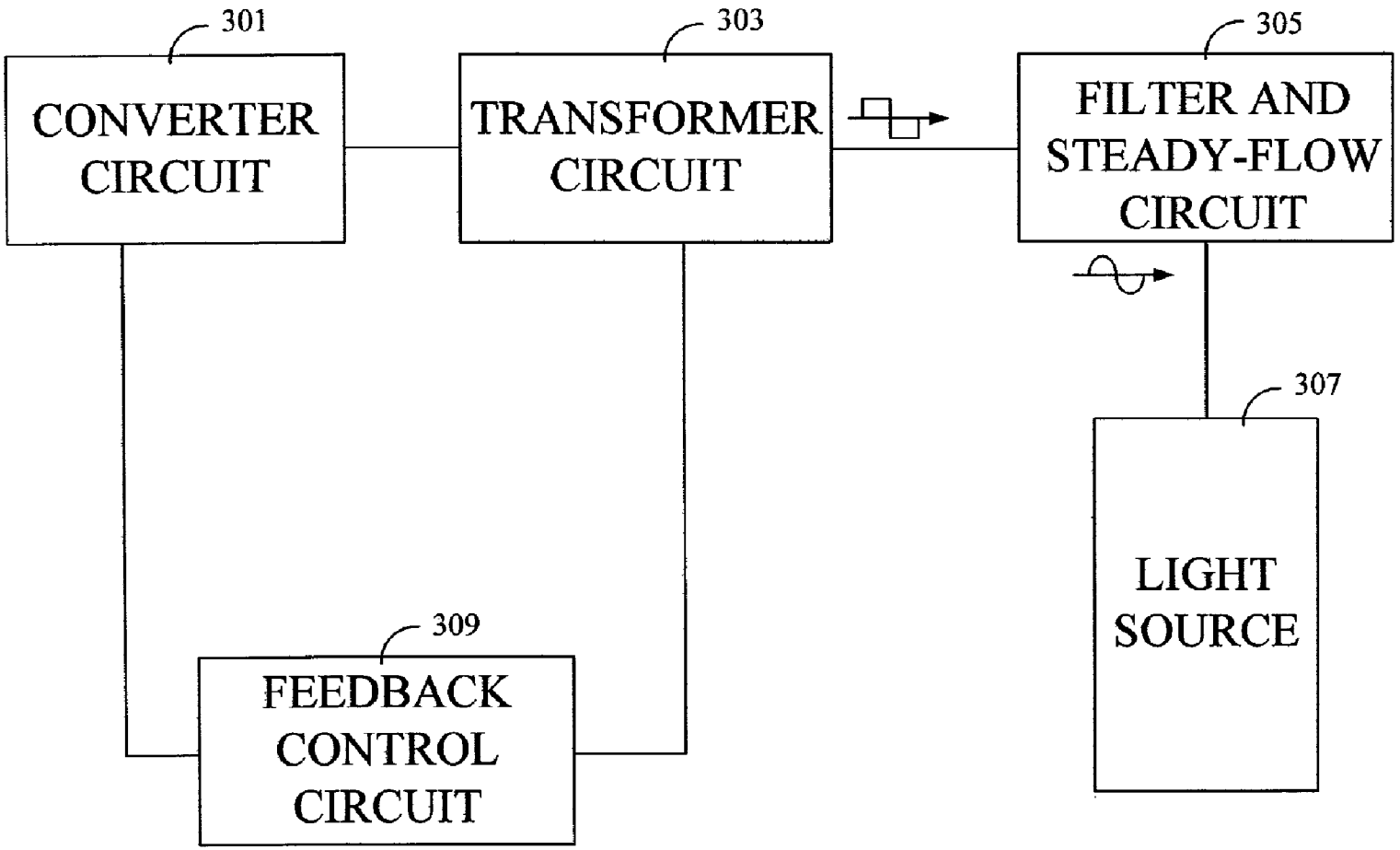
FIG. 8 is a schematic diagram of a power system for driving multiple lamps in accordance with a second preferred embodiment of the invention.

FIG. 8 is a schematic diagram of a power system for driving multiple lamps in accordance with a second preferred embodiment of the invention. In this preferred embodiment, the power system includes a converter circuit 301, a transformer circuit 303, a filter and steady-flow circuit 305, a light source 307, and a feedback control circuit 309. The difference between FIG. 8 and FIG. 5 is that the feedback control circuit 309 is coupled between the transformer circuit 303 and the converter circuit 301. The feedback control circuit 309 controls the converter circuit 301 according to feedback signals received from the transformer circuit 303.

Figure 9:
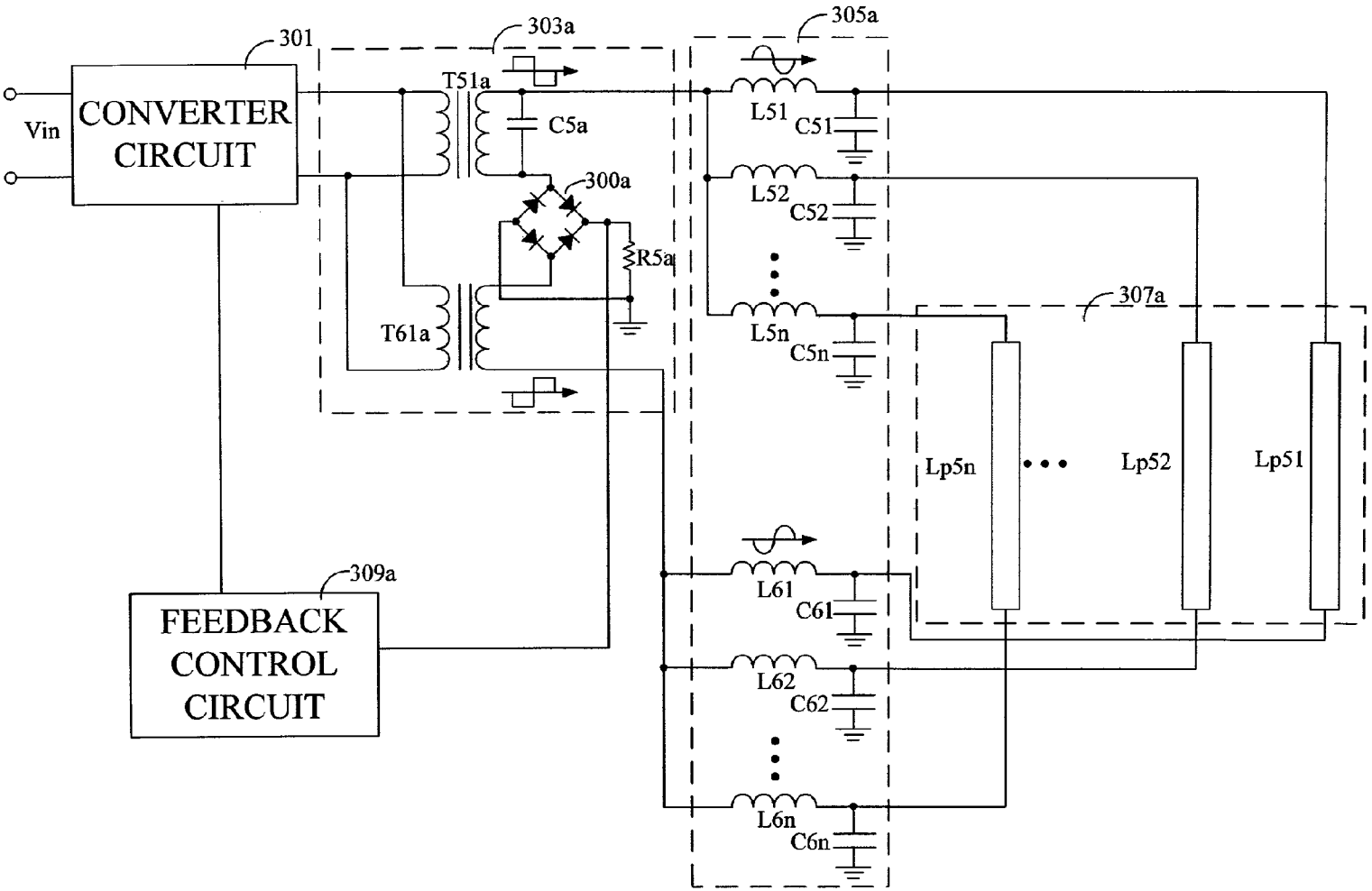
FIG. 9 shows a circuit diagram of the second preferred embodiment of FIG. 8.

FIG. 9 shows an exemplary circuit diagram of the second preferred embodiment of FIG. 8. In this preferred embodiment, a transformer circuit 303*a* includes a transformer T51*a*, a transformer T61*a*, a full-bridge circuit 300*a*, a capacitor C5*a*, and a resistor R5*a*. Primary windings of the transformers T51*a* and T61*a* are connected to the converter circuit 301 in parallel. One end of a secondary winding of the transformer T51*a* is a first output end, and the other end of the secondary winding of the transformer T51*a* is connected to a first end of the full-bridge circuit 300*a*. The capacitor C5*a* is connected between the first output and the second output of the transformer T51*a*. One end of a secondary winding of the transformer T61*a* is connected to a third end of the full-bridge circuit 300*a* opposite to the first end. A second end of the full-bridge circuit 300*a* is grounded through the resistor R5*a*. A fourth end of the full-bridge circuit 300*a* opposite to the second end is grounded. The other end of the secondary winding of the transformer T61*a* is a second output end. A feedback control circuit 309*a* is coupled between the second end of the full-bridge circuit 300*a* and the converter circuit 301. The full-bridge circuit 300*a* retrieves feedback signals from the transformers T51*a* and T61*a*. The full-bridge circuit 300*a* further outputs the feedback signals to the feedback control circuit 309*a*.

Figure 7:
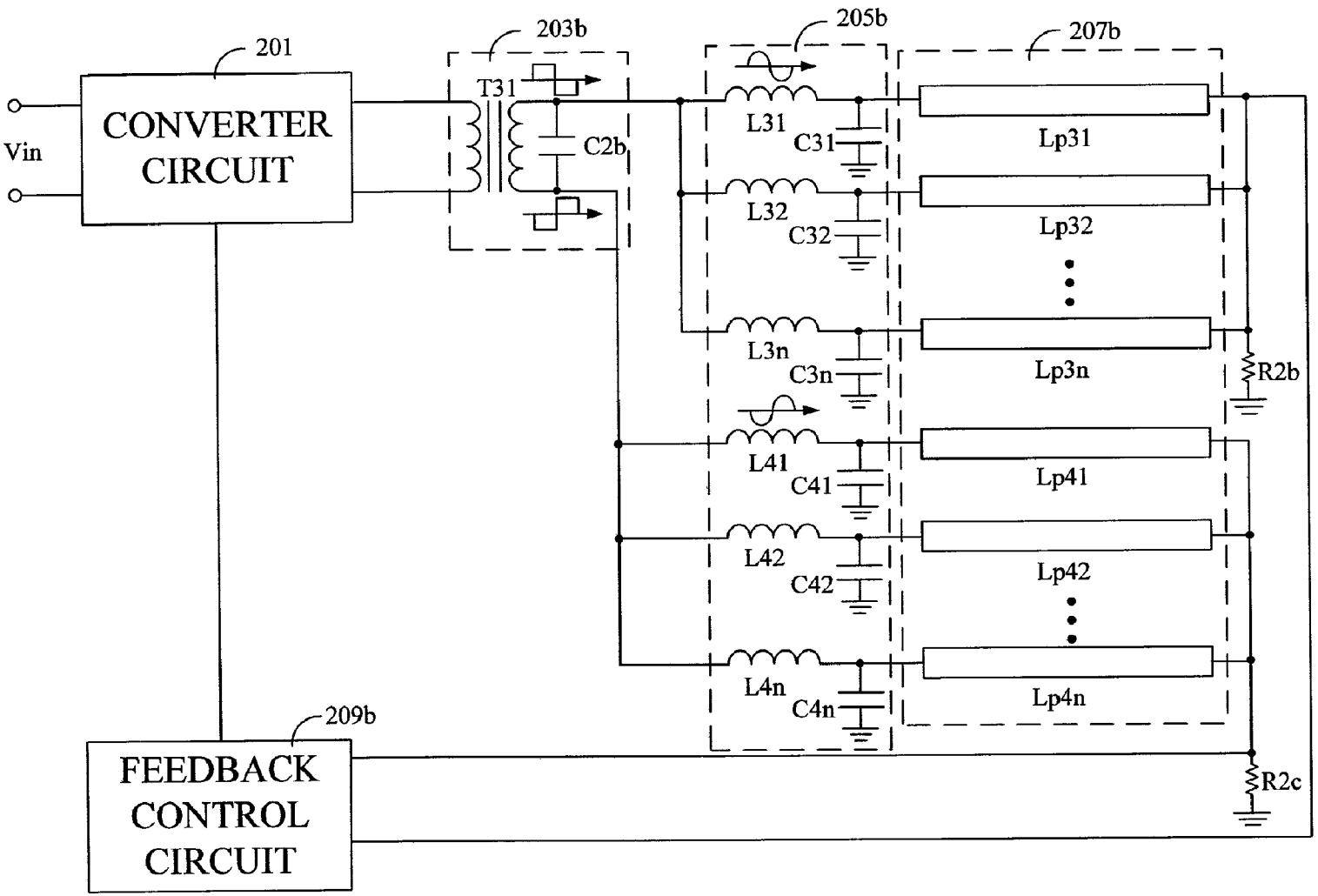
FIG. 7 shows an alternative circuit diagram of the first preferred embodiment of FIG. 5.

A filter and steady-flow circuit 305*a* includes multiple first filter and steady-flow units and multiple second filter and steady flow units, which output third AC signals and fourth AC signals respectively. Another difference between the filter and steady-flow circuit 305*a* of FIG. 9 and the filter and steady-flow circuit 205*b* of FIG. 7 is that each of lamps Lp51, Lp52, . . . , Lp5*n* of a light source 307*a* has a first end connected to a respective first filter and steady-flow unit, and a second end connected to a respective second filter and steady-flow unit. Each lamp Lp51, Lp52, . . . , Lp5*n* is driven by a third AC signal and a fourth AC signal simultaneously.

In this preferred embodiment, the impedance associated with each of the inductors L51, L52, . . . , L5*n*, L61, L62, . . . , L6*n* is substantially the same, and the impedance associated with each of the capacitors C51, C52, . . . , C5*n*, C61, C62, . . . , C6*n* is substantially the same.

Figure 10:
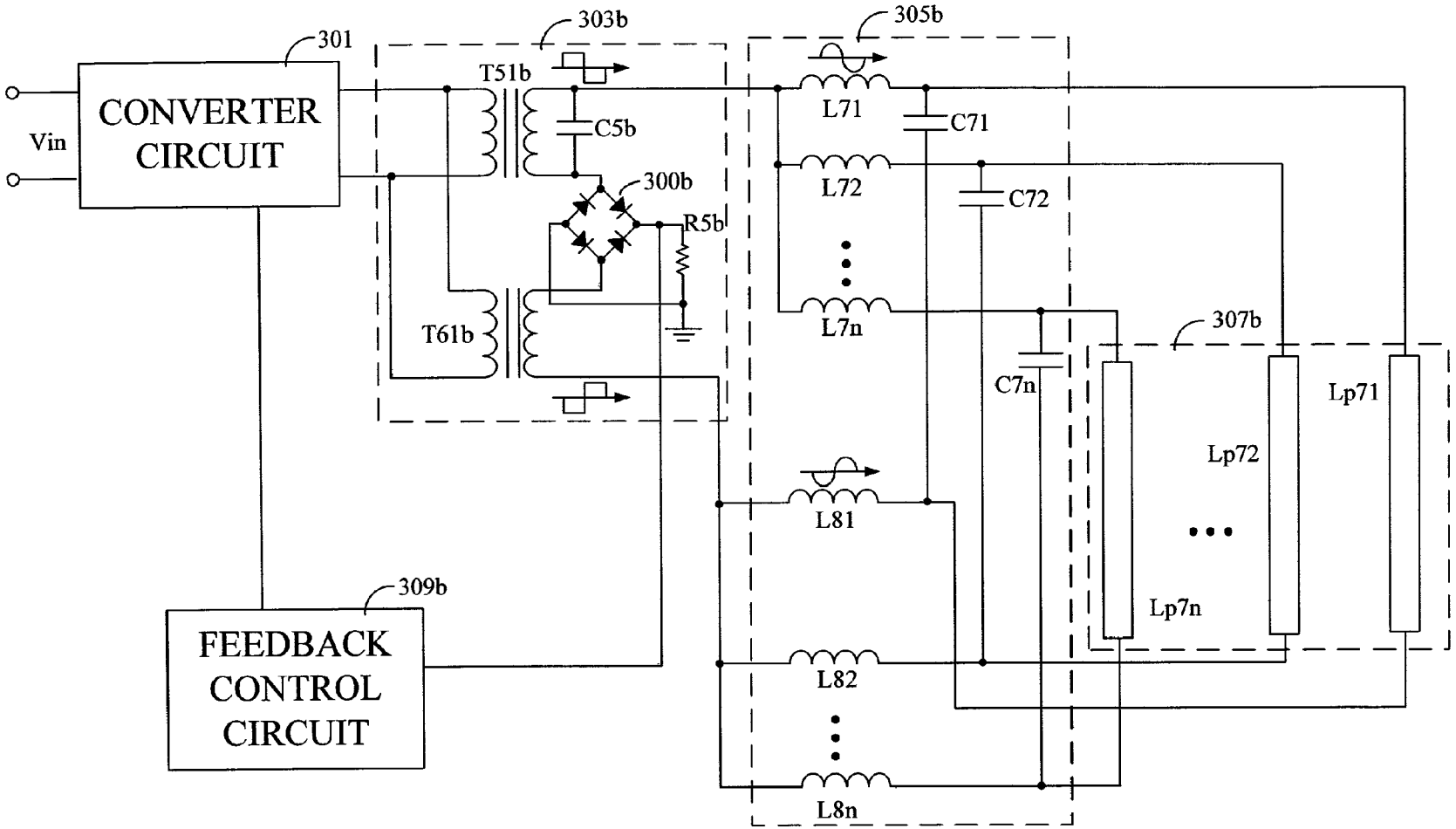
FIG. 10 shows an alternative circuit diagram of the second preferred embodiment of FIG. 8.

FIG. 10 shows an alternative exemplary circuit diagram of the second preferred embodiment of FIG. 8. Elements and connections of the converter circuit 301, a transformer circuit 303*b*, and a feedback control circuit 309*b* are the same as those of corresponding elements and connections shown in FIG. 9. However, the multiple filter and steady-flow units in a filter and steady-flow circuit 305*b* of FIG. 10 are different from those shown in FIGS. 6, 7 and 9.

The filter and steady-flow circuit 305*b* includes multiple inductors L71, L72, . . . , L7*n*, L81, L82, . . . , L8*n*, and multiple capacitors C71, C72, . . . , C7*n*. The inductors L71, L72, . . . , L7*n* are connected to a first output end of the secondary winding of the transformer circuit 303*b*, and the inductors L81, L82, . . . , L8*n* are connected to a second output end of the secondary winding of the transformer circuit 303*b*. In this preferred embodiment, each filter and steady-flow unit includes two inductors and a capacitor. One inductor L71, L72, . . . , L7*n* of each of the filter and steady-flow units has one end connected to the first output end of the transformer circuit 303*b*, and the other end of each inductor L71, L72, . . . , L7*n* is a third output end. The other corresponding inductor L81, L82, . . . , L8*n* of each of the filter and steady-flow units has one end connected to the second output end of the transformer circuit 303*b*, and the other end of each inductor L81, L82, . . . , L8*n* is a fourth output end. The capacitor C71, C72, . . . , C7*n* of each of the filter and steady-flow units is connected between the third output end of the filter and steady-flow unit and the corresponding fourth output end of the filter and steady-flow unit. For example, the inductors L71 , L81 and the capacitor C71 form a first filter and steady-flow unit. The filter and steady-flow units filter and suppress harmonic signals of a first AC signal outputted by the first output end and a second AC signal outputted by the second output end. Further, the filter and steady-flow units output third AC signals from the third output ends and fourth AC signals from the fourth output ends. The third AC signals and the fourth AC signals are opposite in phase. Each of lamps Lp71, Lp72, . . . , Lp7*n* of a light source 307*b* has a first end connected to the third output end of a respective filter and steady-flow unit, and a second end connected to a fourth output end of the respective filter and steady-flow unit Each of the lamps Lp71, Lp72, . . . , Lp7*n* is simultaneously driven by a third AC signal and a fourth AC signal.

In this embodiment, the impedance associated with each of the inductors L71, L72, . . . , L7*n*, L81, L82, . . . , L8*n* is substantially the same, and the impedance associated with each of the capacitors C71, C72, . . . , C7*n* is substantially the same.

Figure 11:
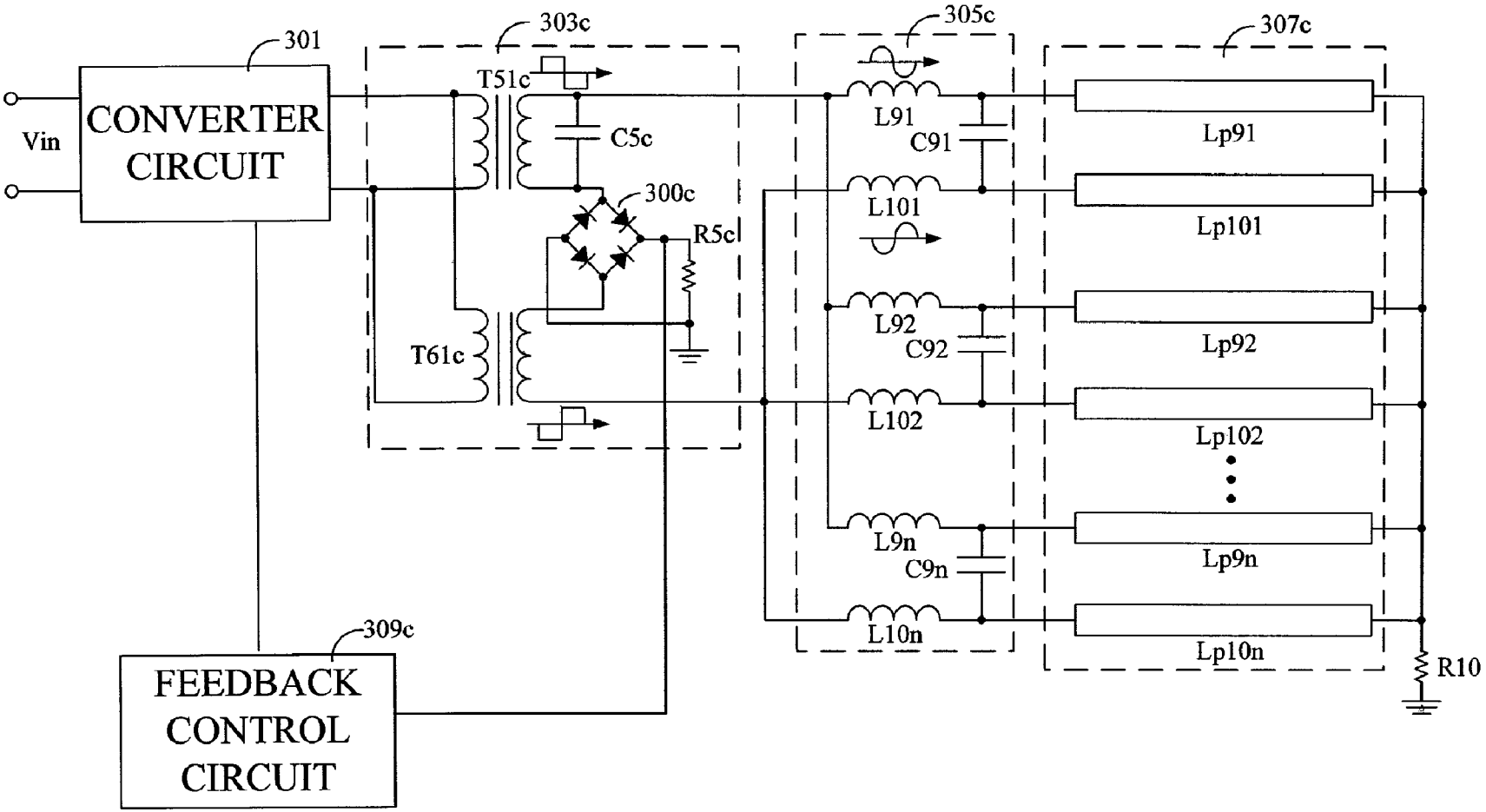
FIG. 11 shows a further alternative circuit diagram of the second preferred embodiment of FIG. 8.

FIG. 11 shows a further alternative exemplary circuit diagram of the second preferred embodiment of FIG. 8. Elements and connections of the converter circuit 301, a transformer circuit 303*c*, a filter and steady-flow circuit 305*c*, and a feedback control circuit 309*c* are the same as those of corresponding elements and connections shown in FIG. 10. In the exemplary embodiment of FIG. 11, a light source 307*c*, which is different from that shown in FIG. 10, includes multiple first lamps Lp91, Lp92, . . . , Lp9*n* and multiple second lamps Lp101, Lp102, . . . , Lp10*n*. Each of the first lamps Lp91, Lp92, . . . , Lp9*n* has a first end connected to a third output end of a respective filter and steady-flow unit, and a second end grounded through a resistor R210. Each of the first lamps Lp91, Lp92, . . . , Lp9*n* is respectively driven by a third AC signal. Each of the second lamps Lp101, Lp102, . . . , Lp10*n* has a first end respectively connected to a fourth output end of a corresponding filter and steady-flow unit, and a second end grounded through the resistor R10. Each of the second lamps Lp101, Lp102, . . . , Lp10*n* is respectively driven by a fourth AC signal.

In the exemplary embodiment, the impedance associated with each of the inductors L91, L92, . . . , L9*n*, L101, L102, . . . , L10*n* is substantially the same, and the impedance associated with each of the capacitors C91, C92, . . . , C9*n* is substantially the same.

The power systems shown in FIGS. 7 to 11 are configured according to the same or similar principles and have the same or similar advantages as those described above in relation to the power system of FIG. 6.

Figure 12:
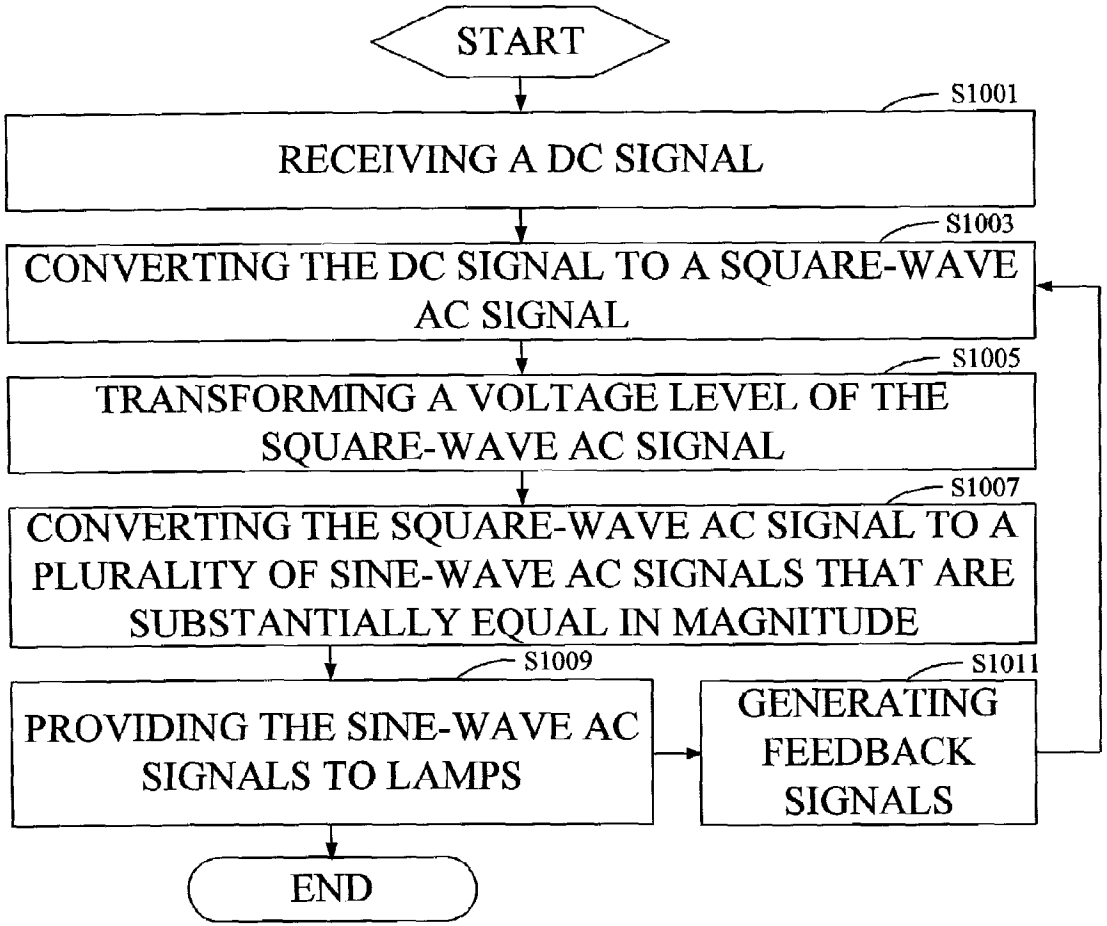
FIG. 12 is a flow chart showing exemplary steps associated with a method for driving multiple lamps of a third preferred embodiment of the invention.

FIG. 12 is a flow chart showing exemplary steps associated with a method for driving multiple lamps of a third preferred embodiment of the invention. For the purposes of conveniently illustrating the method, it is described below as being implemented in the power system of FIG. 5. In step S1001, the converter circuit 201 receives a DC signal. In step S1003, the converter circuit 201 converts the DC signal to a square-wave AC signal. In step S1005, the transformer circuit 203 transforms a voltage level of the square-wave AC signal. In step S1007, the filter and steady-flow units of the filter and steady-flow circuit 205 convert the transformed square-wave AC signal to a plurality of sine-wave AC signals that are substantially equal in magnitude. Then in step S1009, the sine-wave AC signals are provided to the lamps of the light source 207. In step S1011, the light source 207 generates feedback signals, and outputs the feedback signals to the feedback control circuit 209. Accordingly, then returning to step S1003, the feedback control circuit 209 controls the converter circuit 201 to convert the DC signal to a square-wave AC signal according to the feedback signals.

Figure 13:
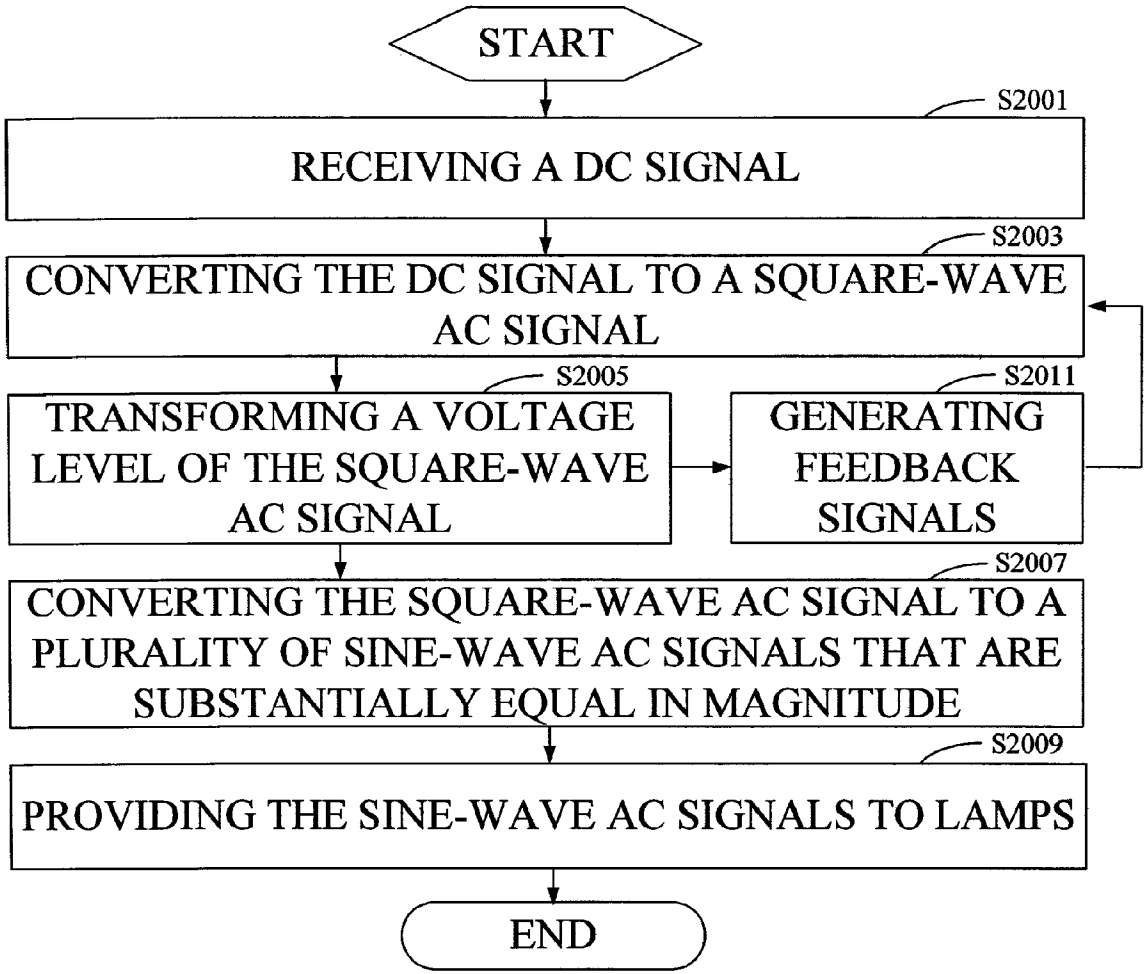
FIG. 13 is a flow chart showing exemplary steps associated with a method for driving multiple lamps of a fourth preferred embodiment of the invention.

FIG. 13 is a flow chart showing exemplary steps associated with a method for driving multiple lamps of a fourth preferred embodiment of the invention. For the purposes of conveniently illustrating the method, it is described below as being implemented in the power system of FIG. 8. Steps S2001, S2003, S2005, S2007 and S2009 are substantially similar to or the same as corresponding steps S1001, S1003, S1005, S1007 and S1009 of FIG. 12. However, in step S2011, the transformer circuit 303 generates feedback signals, and outputs the feedback signals to the feedback control circuit 309. Accordingly, then returning to step S1203, the feedback control circuit 309 controls the converter circuit 301 to convert the DC signal to a square-wave AC signal.

The foregoing disclosure of various preferred and alternative embodiments has been presented for purposes of illustration and description. It is not intended to be exhaustive or to limit the invention to the precise forms disclosed. Many variations and modifications of the embodiments described herein will be apparent to one of ordinary skill in the art in light of the above disclosure. The scope of the invention is to be defined only by the claims appended hereto and their equivalents.

In addition, in describing representative embodiments, the specification may have presented a method and/or process as a particular sequence of steps. However, to the extent that the method or process does not rely on the particular order of steps set forth herein, the method or process should not be construed to be limited to the particular sequence of steps described. As one of ordinary skill in the art would appreciate, other sequences of steps may be possible. Therefore, the particular order of the steps set forth in the specification should not be construed as limitations on the claims. Further, the claims directed to a method and/or process of the present invention should not be limited to the performance of their steps in the order written, and one skilled in the art can readily appreciate that the sequences may be varied and still remain within the spirit and scope of the present invention.

What is claimed is:

1. A power system for driving plural lamps, comprising:

a transformer circuit for transforming a voltage level of an input alternating current (AC) signal, the transformer circuit having a first output end for outputting a first AC signal and a second output end for outputting a second AC signal, wherein the first AC signal and the second AC signal are opposite in phase;

a filter and steady-flow circuit having a first plurality of filter and steady-flow units connected to the first output end for suppressing harmonic signals of the first AC signal and outputting a plurality of third AC signals, wherein each of the first plurality of filter and steady-flow units comprises an inductor and a capacitor; and a light source having a first plurality of lamps, each of the first plurality of lamps having one end connected to a respective one of the first plurality of filter and steady-flow units so as to be driven by a respective one of the plurality of third AC signals;

wherein the inductor of the each of the first plurality of filter and steady-flow units is coupled between the first output end and respective one of the first plurality of lamps of the light source, and the capacitor of the each of the first plurality of filter and steady-flow units has one end coupled between the inductor and the lamp and another end grounded;

wherein impedance associated with each of the inductors of the first plurality of filter and steady-flow units is substantially the same, and impedance associated with each of the capacitors of the first plurality of filter and steady-flow units is substantially the same, for making the plurality of third AC signals flowing through the first plurality of lamps substantially the same and for minimizing influence impedance of the first plurality of lamps on plurality of third AC signals.

2. The power system of claim 1, wherein the second output end of the transformer circuit is rounded.

3. The power system of claim 1, further comprising:

a converter circuit connected to the transformer circuit, for converting an input DC signal to the input AC signal and outputting the input AC signal to the transformer circuit; and a feedback control circuit, coupled between the light source and the converter circuit, for controlling the converter circuit according to one or more feedback signals received from the light source.

4. The power system of claim 1, further comprising:

a converter circuit connected to the transformer circuit, for convening an input DC signal to the input AC signal and outputting the input AC signal to the transformer circuit; and a feedback control circuit, coupled between the transformer circuit and the converter circuit, for controlling the converter circuit according to one or more feedback signals received from the transformer circuit.

5. The power system of claim 1, wherein the filter and steady-flow circuit further comprises a second plurality of filter and steady-flow units connected to the second output end for suppressing harmonic signals of the second AC signal and outputting a plurality of fourth AC signals.

6. The power system of claim 5, wherein the plurality of third AC signals and the plurality of fourth AC signals are substantially the same in magnitude but opposite in phase.

7. The power system of claim 6, wherein each of the second plurality of filter and steady-flow units comprises an inductor having one end connected to the second output end of the transformer circuit and another end outputting a respective one of the plurality of fourth AC signals and a capacitor having one end connected to the another end of the inductor and another end grounded.

8. The power system of claim 7, wherein the light source further comprises a second plurality of lamps, each of the second plurality of lamps having one end connected to the another end of the inductor of a respective one of the second plurality of filter and steady-flow units so as to be driven by the respective one of the plurality of fourth AC signals.

9. The power system of claim 7, wherein each of the first plurality of lamps has another end connected to the another end of the inductor of a respective one of the second plurality of filter and steady-flow units so as to be driven by the respective one of the plurality of third AC signals and the respective one of the plurality of fourth AC signals simultaneously.

10. A power system for driving plural lamps, comprising:

a transformer circuit for transforming a voltage level of an input alternating current (AC) signal, comprising a first output end for outputting a first AC signal and a second output end for outputting a second AC signal, wherein the first AC signal and the second AC signal are opposite in phase;

a filter and steady-flow circuit, comprising a plurality of filter and steady-flow units respectively connected to the first output end and the second output end for suppressing harmonic signals of the first AC signal and the second AC signal, wherein each of the plurality of filter and steady-flow units comprises a third output end and a fourth output end, which respectively output a plurality of third AC signals and a plurality of fourth AC signals, wherein each of the plurality of filter and steady-flow units further comprises a first inductor having one end coupled to the first output end of the transformer circuit and another end defining the third output end, a second inductor having one end coupled to the second output end of the transformer circuit and another end defining the fourth output end, and a capacitor coupled between the third output end and the fourth output end; and a light source comprising a first plurality of lamps, each of the first plurality of lamps having one end connected to the third output end of a corresponding one of the plurality of filter and steady-flow units so as to be driven by a corresponding one of the plurality of third AC signals;

wherein impedance associated with each of the first and second inductors is substantially the same, and impedance associated with each of the capacitors is substantially the same, such that each of the plurality of third AC signals and a corresponding one of the plurality of fourth AC signals are substantially the same in magnitude but opposite in phase and for minimizing influence impedance of the first plurality of lamps on the plurality of third AC signals.

11. The power system of claim 10, wherein the light source further comprises a second plurality of lamps, each of the second plurality of lamps having one end connected to the fourth output end of a corresponding one of the plurality of filter and steady-flow units so as to be driven by the corresponding one of the plurality of fourth AC signals.

12. The power system of claim 10, wherein each of the first plurality of lamps has another end connected to the fourth output end of a corresponding one of the filter and steady-flow units so as to be driven by the corresponding one of the plurality of third AC signals and a corresponding one of the plurality of fourth AC signals simultaneously.

13. The power system of claim 11, further comprising:

a converter circuit connected to the transformer circuit, for converting an input DC signal to the input AC signal and outputting the input AC signal to the transformer circuit; and a feedback control circuit coupled between the light source and the converter circuit, for controlling the converter circuit according to one or more feedback signals received from the light source.

14. The power system of claim 10, further comprising:

a converter circuit connected to the transformer circuit, for convening an input DC signal to the input AC signal and outputting the input AC signal to the transformer circuit; and a feedback control circuit, coupled between the transformer circuit and the converter circuit, for controlling the converter circuit according to one or more feedback signals received from the transformer circuit.

* * * * *